United States Patent [19]

Ricard

[11] Patent Number: 4,864,718

[45] Date of Patent: Sep. 12, 1989

[54] DEVICE FOR MECHANICALLY CONNECTING TERMINALS ON A SET OF CONDUCTIVE WIRES TO RESPECTIVE TERMINALS OR SLOTS OF AN ELECTRICAL COMPONENT

[76] Inventor: Claude F. Ricard, Villa Sainte Madeleine - 52, Cours Gambetta, 13100 Aix-en-Provence, France

[21] Appl. No.: 216,346

[22] Filed: Jul. 7, 1988

[30] Foreign Application Priority Data

Jul. 17, 1987 [FR] France ..... 87 10338

[51] Int. Cl.[4] ..... H05U 3/32

[52] U.S. Cl. ..... 29/739; 29/747

[58] Field of Search ..... 29/842, 845, 739, 747

[56] References Cited

U.S. PATENT DOCUMENTS

| | | | |
|---|---|---|---|
| 3,727,294 | 4/1973 | Coller | 845 X/ |
| 4,033,031 | 7/1977 | Ballow | 29/842 |
| 4,265,013 | 5/1981 | Brown et al. | 29/845 X |
| 4,631,817 | 12/1986 | Bailey et al. | 29/845 X |
| 4,658,503 | 4/1987 | Eaton | 29/842 X |

*Primary Examiner*—Timothy V. Eley

*Attorney, Agent, or Firm*—Ladas & Parry

[57] ABSTRACT

A device for mechanically engaging a wire terminal crimped to the end of a conductive wire into a slot in a housing, said wire being one of a set of wires and said device including a hollow rigid tube with a pointed tip at its front end constituted by flaps which are capable of moving apart, said tip being carried by a moving carriage.

10 Claims, 2 Drawing Sheets

DEVICE FOR MECHANICALLY CONNECTING TERMINALS ON A SET OF CONDUCTIVE WIRES TO RESPECTIVE TERMINALS OR SLOTS OF AN ELECTRICAL COMPONENT

The invention relates to a method and to a device for mechanically connecting terminals forming a part of a plurality of conductive wires fitted with such terminals to respective terminals or in respective slots of an electrical component.

The technical field of the invention is the construction of electrical or electronic equipment.

BACKGROUND OF THE INVENTION

Robots are known which automatically cut up a conductive wire into portions of given lengths corresponding to a set of wires required for fitting to a machine or apparatus or to a portion thereof, said robot automatically crimping an electrical connector portion or "wire terminal" on each wire end. Various different shapes of wire terminal are suitable, for example a pin, a sleeve, a tongue with curled-over edges, etc.

Robots are also known which, after they have cut the wires and have crimped wire terminals on the ends thereof, are capable of individually inserting each wire terminal into a respective slot in an insulating housing in order to build up a connector, or are capable of individually connecting each wire terminal to a respective mating "component terminal" forming a part of a terminal block of an electrical component, e.g. a thermostat, a timer, a sensor, a programmer, etc.

French patent application 86/16.777 (C. Ricard) describes a method and apparatus for automatically taking the wire terminals crimped on conductive wires and connecting them to a set of electrical components by means of a pallet on which the components of a machine are mounted, which pallet is itself mounted on a moving table which is displaceable along two axes relative to a carriage which is displaceable along a third axis, said carriage carrying a moving clamp which individually grasps each wire terminal and which fits it to a component terminal or which engages it in a slot of an insulating housing.

When the pallet carries a large number of components, or when terminal blocks have a large number of terminals, or when the insulating housings include a large number of slots, or when a single component includes a plurality of terminals or slots, then a quantity of conductive wires rapidly builds up in front of the component terminals or insulating housings and constitutes a cluster of wires criss-crossing in all directions, such that new wire terminals conveyed by the moving clamp have difficulty in passing through said cluster of wires, thereby denying access to some of the component terminals or to some of the slots.

The object of the invention is to provide a method and apparatus for solving this problem.

SUMMARY OF THE INVENTION

The present invention provides a method of mechanically connecting a wire terminal crimped to a wire constituting one of a set of wires having said wire terminal crimped thereto to a respective component terminal or in a respective slot of one or more electrical components, the method being of the type in which one or more electrical components are placed facing one or more clamps capable of moving along a first axis which is parallel to the axes of said component terminals or said slots, with each clamp grasping one of said wires immediately behind the wire terminal crimped thereon and in which one or more of said component terminals and/or one or more said slots is/are brought into alignment with said axis of one or more of said clamps by relative displacement along two other axes perpendicular to said first axis, said method comprising the following operations:

one or more hollow rigid tubes extending parallel to the axes of said component terminals or said slots are engaged through the cluster of wires to be found in front of said components, each of said tubes being in alignment with one of said clamps, each tube having a pointed tip at its front end constituted by a plurality of flaps which are capable of being moved apart from one another, each tube having an open rear end, each tube being displaced along said axis of one of said component terminals or of said slots placed in alignment with one of said clamps until said tip is located in the proximity of said component terminal or said slot;

said flaps are moved apart from each other;

one of said wire-holding clamps is axially engaged in each tube until said wire terminal is engaged with said component terminal or in said slot;

said clamps are caused to release said wires;

said rigid tubes are taken out from the cluster of wires;

the wires are taken out from said tubes;

said flaps are closed;

said clamps are axially removed from said tubes;

relative displacement is performed between said components and said clamps with said rigid tubes in order to bring other component terminals and/or other slots into alignment with said clamps; and a new cycle is started.

Advantageously, said rigid tubes are caused to vibrate while they are being engaged through the cluster of wires in order to facilitate penetration of said tubes through said cluster.

In a preferred implementation, the flaps constituting the tip of said rigid tube fold automatically towards said axis and they are moved apart by axially engaging a hollow rigid rod in each rigid tube, said rod serving to push said flaps apart, after which one of said clamps is axially engaged in each of said hollow rods.

The present invention also provides a device for mechanically connecting a wire terminal crimped on a conductive wire to a respective component terminal or in a respective slot of one or more electrical components, said conductive wire constituting a part of a set of wires taken from a cabling robot, the device being of the type comprising a support carrying one or more electrical components and a moving arm or carriage carrying one or more clamps each suitable for grasping one of the conductive wires immediately behind a wire terminal crimped thereon, which support and which arm or carriage are displaceable relative to each other along three axes, one of which is parallel to the axes of said component terminals or slots, said device including a head mounted on said moving arm or carriage and carrying one or more rigid hollow tubes, said tubes being parallel to each other and to the axes of said component terminals and/or said slots, with each of the tubes being coaxial with one of said clamps, the front end of each tube including a pointed tip formed by a plurality of flaps which are capable of being moved apart from each other, and with each tube having an open rear end.

The invention makes it possible to automatically connect the wire terminals fitted to a plurality of wires delivered by a cabling robot on one or more electrical components which may be brought together on a pallet, in spite of the presence of a cluster of criss-crossed wires which interconnect the component terminals which have already received wire terminals and which hinder the passage of new wire terminals.

The rigid tubes provided with pointed tips are capable of clearing a path through the clusters of wires and thus of solving a problem which heretofore had made mechanical connection operations difficult whenever they applied to large numbers of wires, which occurs very frequently since mechanizing connection operations is economically justified particularly when the number of connections that needs to be made is large.

BRIEF DESCRIPTION OF THE DRAWINGS

An embodiment of the invention is described by way of example with reference to the accompanying drawings, in which.

MORE DETAILED DESCRIPTION

Figure 1:
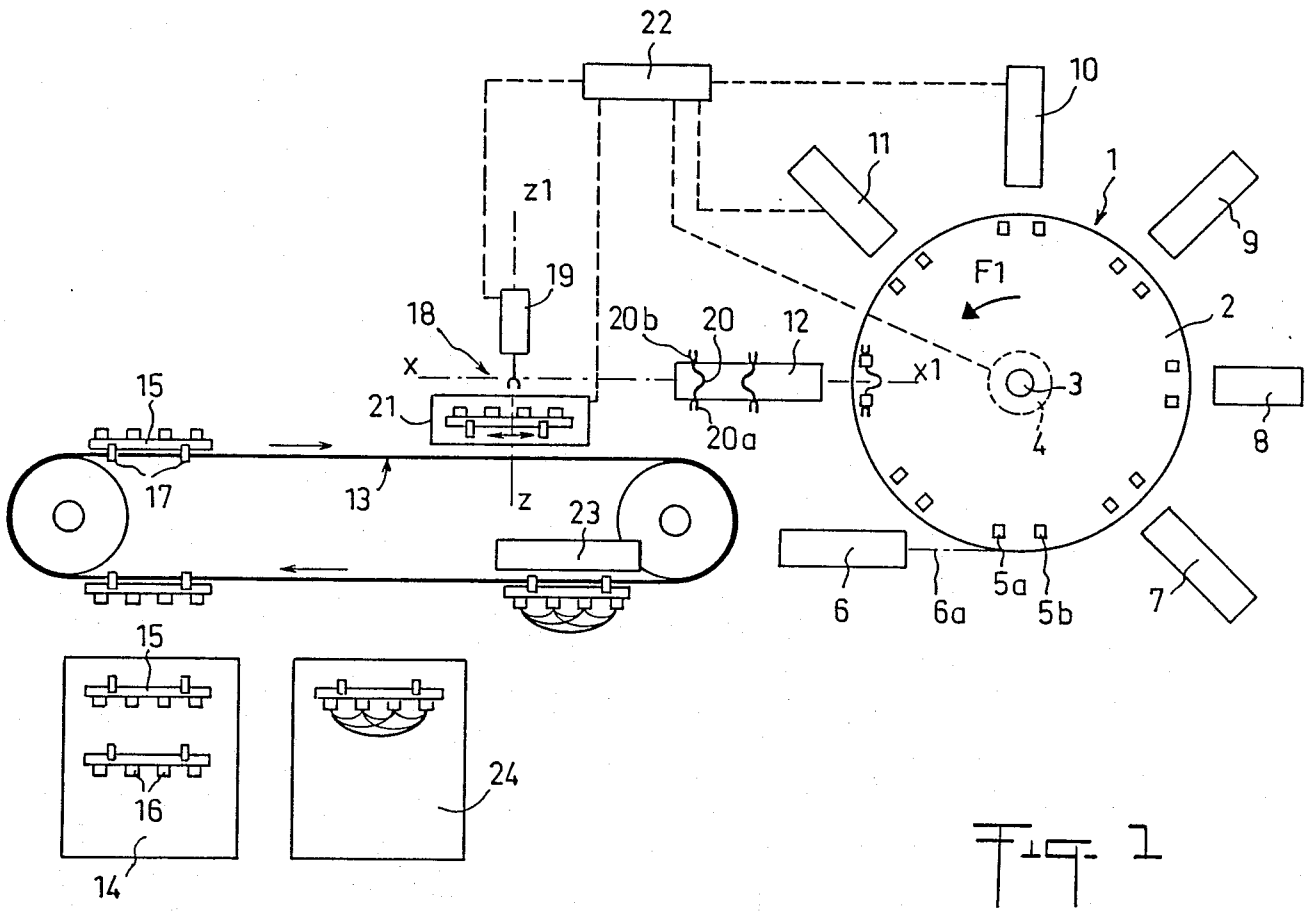
FIG. 1 is an overall diagrammatic plan view of an installation for implementing the method of the invention.

FIG. 1 shows an installation for mechanically preparing sets of conductive wires fitted with wire terminals and for mechanically engaging the wire terminals on the terminal blocks fitted to electrical apparatuses which form portions of a machine or in the slots of insulating housings for building up connectors.

The installation shown includes a cabling robot 1 of any appropriate type.

This robot may, for example, be of the type described in French patent number FR 81/18.181, which corresponds to U.S. Pat. No. 4,494,580. It comprises a circular turntable 2 which is rotated about a vertical shaft 3 by a stepper motor 4 in the direction of arrow F1. The turntable 2 carries pairs of vices or jaws 5*a* and 5*b* around its periphery, each of which pairs is capable of pivoting about a vertical axis.

Work stations are disposed around the periphery of the turntable 2 which acts as a conveyor. For example, a first work station 6 includes means for paying out conductive wire 6*a* tangentially to the turntable 2.

Each length of wire is grasped at its two ends by the two vices 5*a* and 5*b* of a pair. The stepper motor 4 and the motor fitted to the paying-out station 6 are controlled by a computer unit 22 which is programmed to pay out wire in predetermined lengths. Each length forms a loop between a pair of vices 5*a*, 5*b*.

The robot includes other work stations, for example a work station which cuts the wire between two successive lengths, a work station 7 which strips the ends of the wires, a work station 8 which engages an insulating sheath over each stripped wire end, and work stations 9, 10 and 11 which engage and crimp a male or female wire terminal on each stripped wire end.

All of these operations are automatically controlled by the computer unit 22, thereby making it possible to automatically mass-produce sets of wires fitted with wire terminals, with each set containing all of the wires required for equipping a machine or an apparatus or a control panel or an electrical connection cabinet, which items may be mass-produced or else produced on a one-off basis.

Reference 12 designates a work station from which lengths of wire 20 fitted with wire terminals 20*a* and 20*b* are removed. The work station 12 includes a carriage which moves radially relative to the turntable 2 and which includes means for grasping lengths of wire 20.

After each length of wire has been fitted with one or two wire terminals, the wire terminals need to be connected to the components intended to receive them in order to interconnect said electrical components. The components may be electrical or electromechanical apparatuses, for example transformers, inductors, motors, circuit breakers, relays, programmers, timers, etc.

These components are fitted with terminal blocks including a plurality of male or female component terminals each of which is to be connected to a given wire terminal fitted to one of the wires in the set of wires.

In other cases, some of the wire terminals need to be engaged in slots in an insulating housing in order to build up a multi-wire electrical connector for engaging a complementary connector. The term "electrical component" is used to designate any electrical or electromagnetic apparatus including terminals and also to designate insulating housings for receiving wire terminals in order to build up multi-wire connectors.

The insulation shown in FIG. 1 serves to mechanically perform the operations of connecting the wire terminals located on the sets of wires leaving the robot 1 to the set of electrical components used in machines and apparatuses which are mass-produced on a large scale, such that the connection operations themselves need to be performed a large number of times and mechanizing them serves to reduce costs.

Reference 13 designates a conveyor, for example an endless belt serving a plurality of work stations and moving in the direction shown by the arrows.

Reference 14 designates a work station where sets of electrical components 16 each belonging to a common apparatus or to a common subassembly of an apparatus or a machine are fixed on pallets 15 including means for fixing each electrical component on each pallet in a well-determined position such that each component terminal or slot can be located by its coordinates relative to two perpendicular axes defined by the pallet.

The components 16 are placed manually on the pallet. Once fully loaded, each pallet is fixed to the conveyor, for example by hooks 17 so that each pallet is transported in the vertical position to an automatic connection work station 18 which is aligned with work station 12.

The automatic connection work station 18 includes a carriage or moving arm 19 which moves along a first horizontal axis z–z1 perpendicular to the axis x–x1 of work station 12, and which is provided with a clamp for grasping each length of wire 20 immediately behind a wire terminal. In a variant, the carriage 19 may carry a plurality of clamps enabling a plurality of wire terminals to be grasped and connected simultaneously.

The connection station 18 also includes a moving table 21 which includes servo motors enabling it to be displaced along two mutually perpendicular axes which are perpendicular to the axis z–z1, and preferably along a horizontal axis parallel to the axis x–x1 and along a vertical axis y–y1.

The successive displacements of the carriage 19 and the table 21 are controlled by servo motors under the control of the computer unit 22. Each pallet 15 brought by the conveyor is placed in succession on table 21 which includes positioning abutments such that each pallet occupies exactly the same position on the moving table 21, thereby ensuring that the coordinates of each component terminal and of each slot to which a wire terminal is to be connected are accurately known, said co-ordinates being with reference to the axes x–x1 and y–y1 along which the table 21 is displaceable. These co-ordinates are recorded in a memory of the computer unit 22, which memory also stores, for each length of wire, the length of said length, the type or wire terminal, the type of component and the type of terminal on said component to which each wire terminal is to be connected.

The computer unit 22 is programmed to automatically displace the table 21 and the carriage 19 relative to each other so as to enable the carriage to automatically and individually engage each wire terminal with the component terminal or in the slot lying on the axis z–z1.

After all of the wires in a set have been connected to the components fixed on a pallet 15, the pallet is removed from the table 21 and is hooked back on to the conveyor 13 which then presents it to a test work station 23 for verifying that the connections have been made properly. After which, pallets 15 carrying components which are interconnected by sets of wires are recovered by a work station 24 and the components are mounted locally or in a workshop on the machine, apparatus, or subassembly for which they are intended.

All of the above is described in French patent application number 86/16.777.

The automatic connection of the wire terminals on the component terminals or in the slots for receiving them becomes a problem when the set of wires fitted with wire terminals is large, since the wires whose wire terminals have already been connected build up in front of the remaining unconnected component terminals or slots in the form of a cluster of criss-crossed wires constituting an obstacle which is difficult or even impossible for the clamp(s) grasping the lengths of wire behind the wire terminals to pass through by moving along the axis z—z'.

Figure 2:
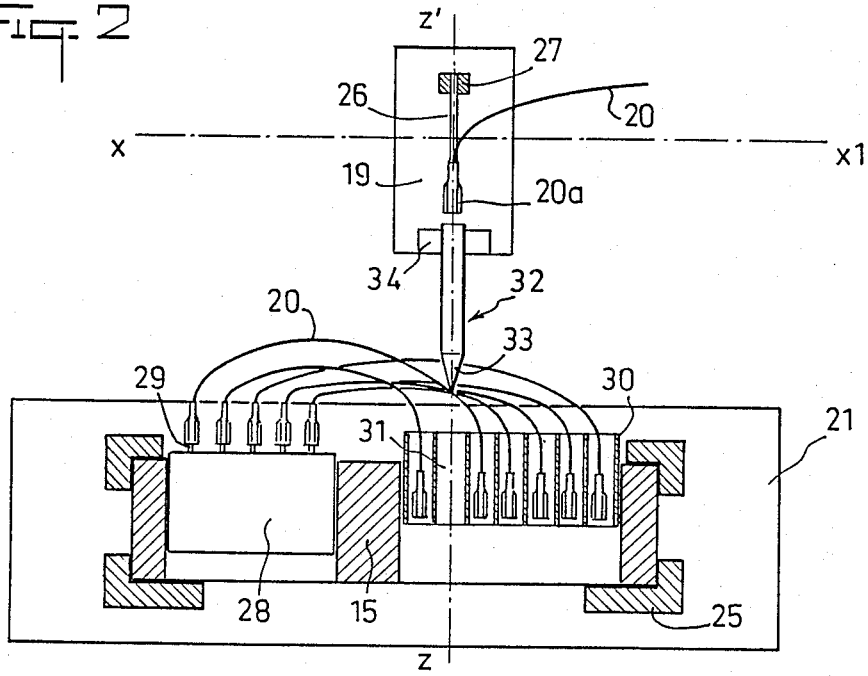
FIG. 2 is a horizontal section through a portion of a device in accordance with the invention.

FIG. 2 is a horizontal section on a larger scale through work station 18 and it shows the moving table 21 carrying a pallet 15 placed between positioning abutments 25, together with the carriage 19 which moves along the axis z—z' and which carries a clamp 26 comprising two arms whose rear ends are clamped between two jaws 27 and whose front ends are themselves clamped about a wire 20 immediately behind the crimping of a wire terminal 20*a*, which in the present example is constituted by a tongue having curled-over edges.

By way of example, this figure shows a pallet 15 carrying an electrical component 28 fitted with a terminal block constituted by conductive tabs 29 each of which is to have a wire terminal 20*a* engaged thereon, and also carrying an insulating housing 30 which delimits slots 31 into each of which a wire terminal 20*a* is to be engaged in order to build up a multi-wire connector.

FIG. 2 shows a stage in operations in which one of the slots 31 which has still not received a wire terminal is located in alignment with the axis z–z1 ready to receive the wire terminal 20*a* held by the clamp 26. It can clearly be seen in this figure that the cluster of wires 20 interconnecting the various component terminals and slots which have already received their wire terminals, constitutes a screen which is difficult to pass through. In order to solve this problem, a device in accordance with the invention comprises a hollow rigid tube 32 which is coaxial with the clamp 26. The rear end of the tube 32 is open while its front end includes a pointed tip 33 constituted by a plurality of flaps which are capable of moving apart from one another.

For example, the tube 32 may be square in section and the tip 33 may comprise three or four triangular sectors which fold against one another to form a pyramid or a portion of a pyramid having a forwardly directed tip.

FIG. 2 shows an example of a device having a single clamp 26 and a single rigid tube 32. In a device including a plurality of clamps, there are a plurality of coaxial rigid tubes, each associated with a corresponding clamp.

The rigid tube 32 is mounted, for example, at the front of the carriage 19 while the clamp 26 is mounted on a support provided with means, e.g. an actuator, enabling it to move along the axis z—z' in order to enable it to move out from the tube 32 in order to grasp a wire.

With the carriage 19, the clamp 26, and the tube 32 in the positions shown in FIG. 2, the carriage is displaced along the axis z—z' until the front end of the tip 33 comes close to the slot 31 or the tab 29 for engagement with the wire terminal 20*a* located at the end of the wire held by the clamp 26.

Figure 3:
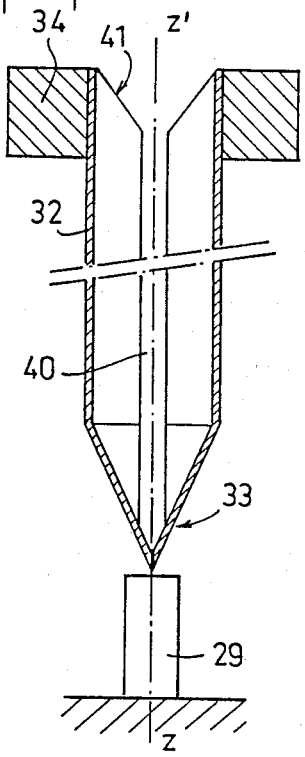
FIG. 3 is an axial section through a rigid tube used in a device in accordance with the invention.

FIG. 3 shows the tube 32 in this position in the proximity of a tab 29 and on a larger scale. During this operation, the tip 33 is closed and facilitates penetration of the tube through the cluster of wires by spreading the wires apart.

Advantageously, the tube 32 is held by a vibrating head 34 such that high frequency vibration facilitate penetration of the tube through the wires.

After the tip 33 has reached the proximity of the component terminal 29 or of a slot 31, the moving flaps 33 are spread apart in order to open the tip, after which the clamp 26 is displaced axially inside the tube 32 until the wire terminal 20*a* engages the terminal tab 26 or is placed inside the slot 31.

Figure 4:
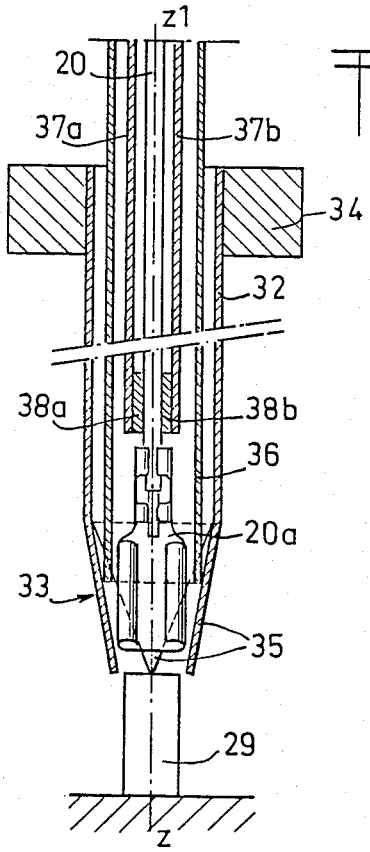
FIG. 4 is an axial section analogous to FIG. 3 showing the relative positions of the various portions of a device in accordance with the invention at the moment when a female wire terminal is being engaged on a male component terminal in the form of a conductive tab.

FIG. 4 is an axial section through a preferred embodiment in the position where the flaps constituting the tip 31 are spread apart and where the clamp 26 is engaged inside the tube 32.

In this example, the tube 32 is square in section and the tip 33 is constituted by four triangular flaps 35 which fold back automatically towards the axis in order to constitute a pyramid.

For example, the flaps 35 are made of steel or of any other resilient material such that when they are moved away from the folded-together position, they are urged back towards said position by resilient forces. In a variant, the flaps 35 could be connected to the tube 32 via hinges and fitted with small return springs which would automatically urge each flap towards the axis.

In the present embodiment, the carriage 19 carries means for axially displacing a hollow rigid rod 36 coaxially with the tube 32 and inside it until it comes into contact with the flap 35 and pushes them apart, as shown in FIG. 4. After this, the clamp 26 holding a wire 20 immediately behind the crimping of a wire terminal 20*a* is engaged into the rod. The inside diameter of the hollow rod 26 is greater than the transverse dimensions of the wire terminals 20*a*.

In FIG. 4, it can be seen that the clamp 26 comprises two arms 37*a* and 37*b* whose front ends are fitted with two small plates 38*a* and 38*b* which engage the wire 20, which plates lie in planes parallel to the longitudinal plane of symmetry of the wire terminal 20*a*, i.e. the plates lie in planes perpendicular to the plane of FIG. 4.

The rear ends of the two arms 37*a* and 37*b* are held by jaws 27 (see FIG. 2) which serve to keep the clamp 38*a* and 38*b* clamped against the wire 20 during axial displacement.

After the wire terminal 20*a* has been engaged on a component terminal 29 or in a slot 31, the central processor causes the jaws 27 to be opened, e.g. by means of an electromagnet. At this moment, the wire 20 fitted with the wire terminal 20*a* lies inside the rigid tube 32 and the hollow rod 36.

FIG. 3 shows a preferred embodiment of a rigid tube which has a longitudinal slot 40 extending along the entire length of the tube, including the bottom flap and running along the bottom face of a square tube or along the bottom geometrical generator lie of a round tube. In a variant, the bottom flap may be omitted.

The width of the slot 40 is greater than the diameter of the wire 20. The rear end of the slot 40 includes a V-shaped notch 41 which is outwardly flared. When a hollow rod 36 is used for pushing the flaps 35 apart, said rod also has a longitudinal slot extending along the entire length of its bottom generator line and outwardly flared at its rear end.

The central processor causes the clamp 26 which has released the wire to move rearwardly together with the rod 36 and the tube 32. The wire engages in the rear notch of the rod 36 and as the tube and the rod move backwards, the wire leaves them via the slot 40 and the corresponding slot in the rod 36.

Thereafter, the central processor causes the table 21 to move up a short distance, thereby fully extracting the wire from the rod 26 and the tube 32. The central processor then returns the hollow rod 36 rearwardly allowing the flaps to close. It also causes the clamp 26 to move out of the tube 32.

The central processor then looks up the next component terminal or slot to be engaged with a new wire terminal and it causes the table 21 to be moved so as to bring the next component terminal or slot into alignment with the axis z–z1, and a new identical cycle is begun until all of the wires in the set of wires have been connected.

In another variant, the tubes 32 and the hollow rods 36 may each be constituted by pairs of half tubes or half rods which are separated by a longitudinal vertical join plane and which are moved towards each other while being thrust forwardly and which are moved away from each other when being extracted rearwardly in order to release the wire 20 which is connected to the wire terminal 20*a* which has just been engaged on a component terminal or in a slot.

I claim:

1. A device for mechanically connecting a set of wire terminals in respective component terminals, each wire terminal being crimped to an electrical wire which device comprises insertion clamping means suitable for grasping one of said wires behind a wire terminal crimped thereon, a support means on which said components are mounted, means for displacing said support and said clamping means relative to each other along three rectangular axes, one of which is parallel to the axes of said component terminals and to the axes of said clamping means and further comprising at least a hollow rigid tube aligned with one of said clamping means having at the front end a pointed tip formed by a plurality of flaps which are movable apart from each other and having an open rear end and further comprising means for displacing said tubes relative to said clamping means along the common axis thereof.

2. A device according to claim 1 further comprising means to vibrate these tubes while they are displaced forwardly in order to make easier the penetration of said tubes through a cluster of wires.

3. A device according to claim 1 wherein said flaps fold inwardly automatically and the device further comprises means for engaging a hollow rigid rod axially in each of said rigid tubes for pushing apart said flaps.

4. A device according to claim 3, wherein each of said rigid hollow rods includes a longitudinal slot along the bottom line thereof.

5. A device according to claim 3, wherein each of said rigid tubes and each of said hollow rods is constituted by two half-tubes or two half-rods which are separated by a longitudinal vertical join plane, which are applied against each other while being thrust forwardly, and which are moved apart from each other while being withdrawn rearwardly.

6. A device according to claim 1 comprising a carriage which carries at least an insertion clamp, which is displaceable relative to said support along three perpendicular axes one of which is parallel to the axe of said insertion clamps and to the axes of said component terminals and said carriage further carries a head carrying a hollow tube aligned with each clamp which head is movable relative to said carriage along an axis parallel to the axis of said clamps.

7. A device according to claim 1, wherein each of said hollow rigid tubes includes a longitudinal slot extending over the entire length of said tube.

8. A device according to claim 7, wherein the width of said slot is greater than the maximum diameter of said wires.

9. A device according to any of claims 7 and 8, wherein said slot is located along the bottom of said hollow rigid tube.

10. A device according to claim 7, wherein said longitudinal slot is located in the bottom of said tube and includes an outwardly flared notch at its read end.

* * * * *